US005427074A

United States Patent [19]

Tuckey

[11] Patent Number: 5,427,074

[45] Date of Patent: Jun. 27, 1995

[54] VENTED FUEL MODULE RESERVOIR

[75] Inventor: Charles H. Tuckey, Cass City, Mich.

[73] Assignee: Walbro Corporation, Cass City, Mich.

[21] Appl. No.: 243,856

[22] Filed: May 17, 1994

[51] Int. Cl.[6] ..... F02M 37/04

[52] U.S. Cl. ..... 123/514; 123/516; 137/571

[58] Field of Search ..... 123/509, 510, 514, 497, 123/516; 137/592, 571

[56] References Cited

U.S. PATENT DOCUMENTS

| | | | |
|---|---|---|---|
| 4,747,388 | 5/1988 | Tuckey | 123/514 |
| 4,869,225 | 9/1989 | Nagata | 123/516 |
| 5,050,567 | 9/1991 | Suzuki | 123/514 |
| 5,070,849 | 12/1991 | Rich | 123/509 |
| 5,139,000 | 8/1992 | Sawert | 137/571 |
| 5,146,901 | 9/1992 | Jones | 123/509 |
| 5,218,942 | 6/1993 | Coha | 123/514 |
| 5,253,628 | 10/1993 | Brown | 123/516 |
| 5,257,916 | 11/1993 | Tuckey | 417/423 |
| 5,263,459 | 11/1993 | Talaski | 123/516 |

*Primary Examiner*—Carl S. Miller

*Attorney, Agent, or Firm*—Barnes, Kisselle, Raisch, Choate, Whittemore & Hulbert

[57] ABSTRACT

A main fuel tank in an automotive vehicle contains a reservoir in which is located a two-stage electrically operated pump. The first stage is a jet pump which draws fuel from the main tank and delivers it to the reservoir. The second stage is a rotary pump which draws from the reservoir and delivers to the vehicle engine. The reservoir has overflow restriction means which allows air to vent while the reservoir is filling but which restricts fuel flow when the reservoir is full. This creates pressure in the reservoir to create back pressure against and shut down flow from the jet pump and also increase pressure on the fuel inlet of the main pump thus increasing the efficiency of the main fuel pump.

8 Claims, 2 Drawing Sheets

VENTED FUEL MODULE RESERVOIR

FIELD OF THE INVENTION

A fuel reservoir in a main vehicle fuel tank with a power driven pump in the reservoir which receives fuel from a return line in the vehicle fuel system.

BACKGROUND OF THE INVENTION

In vehicle fuel systems, an electrically driven fuel pump is mounted in a fuel reservoir which, in turn, is located in the main vehicle fuel tank. The pump has an outlet leading to a fuel rail which distributes operating fuel to fuel injection units in a fuel rail at the engine. In some fuel systems, the pump has a capacity greater than that required by the engine and a pressure relief valve discharges over-capacity fuel to a return line which dumps into the reservoir.

Also, in some systems, the fuel pump has a main outlet directed to the engine and a diversion outlet directed to a jet pump at the base of the reservoir. The jet pump has a fuel tank inlet, independent of the main pump inlet, which, in connection with a venturi passage, moves fuel into the reservoir to maintain a supply of fuel in the reservoir, independent of fuel in the main tank of the vehicle.

Some systems have provided for over flow of fuel from the reservoir to the main tank. However, the reservoir fuel may be hot due to the return flow and it is not desirable that hot fuel reach the main tank. Also, it is desirable that the reservoir be closed at the top to create a back pressure on the jet pump and accordingly increase the pressure at the main fuel inlet to provide a force feed to the main pump.

SUMMARY OF THE INVENTION

A main fuel tank in an automotive vehicle contains a reservoir holding an electrically operated pump. The pump has a main fuel outlet at the top of the reservoir directing fuel to the vehicle engine, and a secondary outlet directing fuel under pressure to a jet pump which moves fuel from an inlet at the base of the reservoir to the interior of the reservoir. A fuel return passage from the fuel system dumps into the top of the reservoir. In some existing fuel systems, fuel in the reservoir is overflowed into the main tank. In the present invention, the reservoir is selectively closed to overflow by either a calibrated vent at the top or a float valve, which will close when the fuel level in the reservoir reaches the top of the reservoir. This closure will cause pressure from the jet pump to increase in the reservoir and essentially shut down the jet pump out flow. The increased pressure in the reservoir will act on fuel entering the main pump inlet and force feed fuel into the pump thereby increasing the efficiency of the system.

Another feature of the invention lies in the fact that hot fuel returning to the reservoir will not heat the fuel in the main tank. Still another feature is the reduction in fuel flow through the primary filter at the base of the reservoir.

It is therefore an object of the invention to provide a top closure in a fuel tank reservoir which will prevent overflow of hot fuel into a main tank. Another object is a scheduled closure of the reservoir dependent on fuel level to develop back pressure against a jet pump outlet thereby stemming flow into the reservoir and effecting a pressure build-up to increase fuel inlet flow to the main pump inlet.

BRIEF DESCRIPTION OF THE DRAWINGS

The above recited objects and features of the invention as well as other objects, features and advantages will be apparent in the following detailed description of the preferred embodiments and best mode, appended claims and accompanying drawings in which:

DETAILED DESCRIPTION

Figure 1:
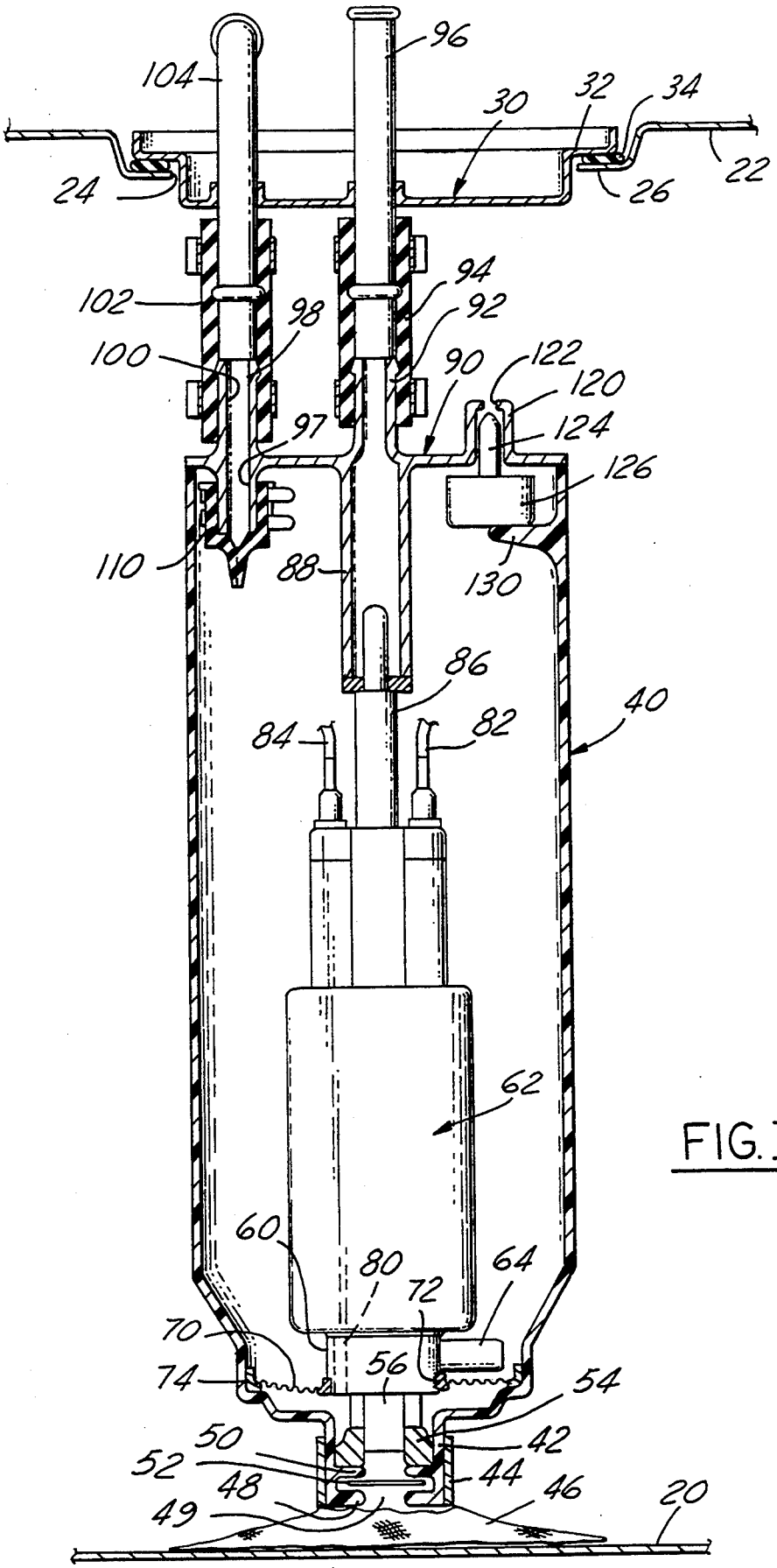
FIG. 1 is a sectional view of an in-tank reservoir with the included fuel pump.

In FIG. 1 of the drawings, the main fuel tank of a vehicle is exemplified by a bottom wall 20 and a top wall 22, the top wall having an opening 24 defined by a depressed annular flange 26. A sealing closure cover 30 has a peripheral flange 32 resting in a sealing ring 34.

Figure 3:
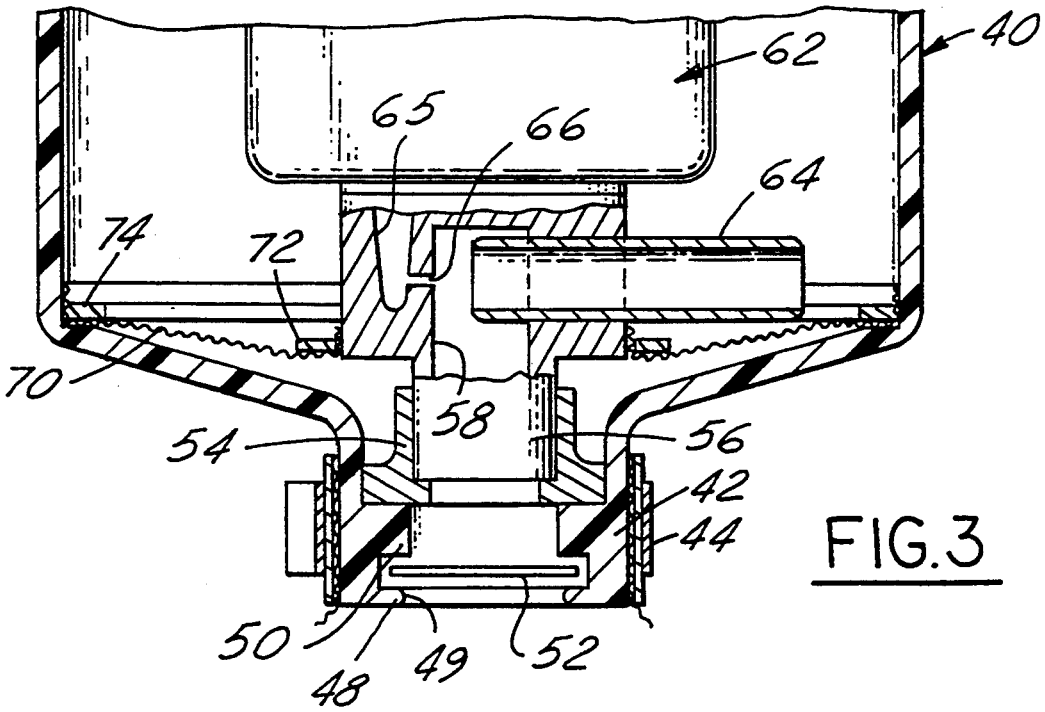
FIG. 3 is a sectional view of the lower end of a reservoir showing the jet pump.

An in-tank fuel reservoir 40 has a narrowed lower end terminating in a boss 42 which is received in a collar 44 in the top of a sock filter 46 resting on the tank bottom 20. The boss 42 has axially spaced annular ribs 48 and 50 between which is a foot valve plate 52. The opening in rib 48 provides a fuel inlet 49. An annular seal 54 fits into the top of the boss 42 and rests against the rib 50, and extending into this seal is a tube 56, the interior of which forms a chamber 58 (FIG. 3) open to the base 60 of an electrically driven pump 62 within the reservoir 40. The pump 62 may be an electrically powered turbine pump as described in a U.S. Pat. No. 5,257,916 (Nov. 2, 1993) to C. H. Tuckey. Extending into the pump base 60 is a venturi tube 64 (FIG. 3), the inner end terminating in chamber 58 and the outer end opening to the interior of the reservoir 40. As shown in FIG. 3, a pump outlet 65 has a jet port 66 which discharges into the inner end of venturi tube 64. FIG. 3 shows a section of the pump base 60 enlarged from the depiction in FIG. 1. The function of the jet pump will be later described.

As shown in FIGS. 1 and 3, an annular fuel filter ring 70 is sealed at inner and outer peripheries by collars 72 and 74 respectively. With reference to FIG. 1, a main pump fuel inlet is illustrated at 80 and fuel from the interior of reservoir 40 will flow through the filter 70 and into the inlet 80.

Turning now to the top of the pump and reservoir, the pump has electrical connections 82 and 84, and a pump outlet tube 86 has a sealed relationship to a hollow outlet conduit 88 depending from a top cover plate 90 on reservoir 40. A conventional wiring system (not shown) initiates operation of the pump when the vehicle ignition system is turned on. Conduit 88 terminates above cover plate 80 in a nipple connection 92 which is attached by a flexible coupling 94 to a fuel passage 96 projecting through the cover 30 and leading to a vehicle engine (not shown).

The top cover plate 90 has also a depending passage 97 and an upstanding passage 98 forming a through passage 100. A flexible coupling 102 connects passage 100 to a system conduit 104 which passes through cover 30. The system conduit 104 is a fuel return passage in a fuel system in which fuel under pressure from the pump delivers fuel to an engine but a pressure regulator valve in the outlet line by-passes fuel above a predetermined pressure back to the reservoir. This is described in U.S. Pat. No. 4,747,388 (May 31, 1988) issued to C. H. Tuckey. At the end of the depending passage 97 is clamped a one-way duckbill valve 110 which admits return fuel to the interior of the reservoir but blocks any outward flow.

The present invention is directed to venting at the top of the reservoir. It will be appreciated that, if fuel is to enter the reservoir, there must be a means of venting air above the fuel. In FIG. 1, an upstanding valve chamber 120 is provided with a valve seat opening 122. A valve stem 124 has a loose fit in the chamber 120 and is supported on a float block 126, which is retained in a lowest position by a short shelf 130. Accordingly, when the reservoir is filling, air can escape around the valve stem 124. When the liquid fuel level reaches the top, the float will raise the valve stem so that the tapered end will close the valve opening 122 and pressure will build up in the reservoir.

Figure 2:
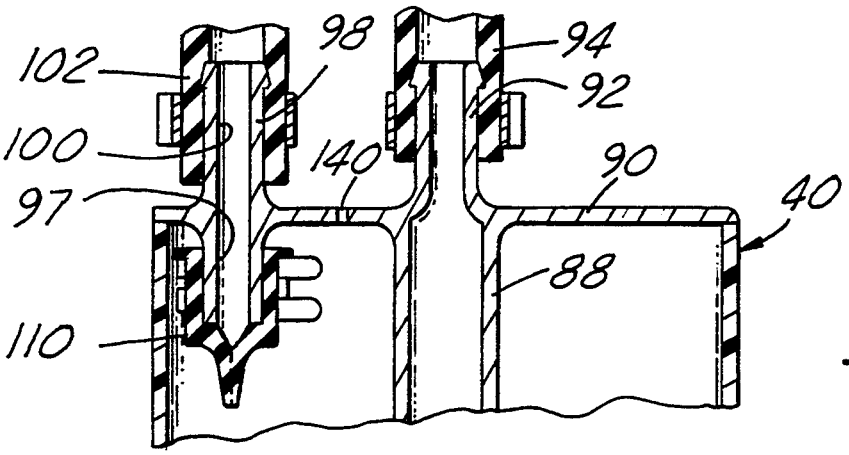
FIG. 2 is a fragmental view of the top of the reservoir with an optional control vent.

In FIG. 2, a vent is illustrated in the form of a small calibrated port 140. This port will vent air from the reservoir while it is filling. When liquid reaches the port it will not pass readily through the port and pressure will build up in the reservoir.

OPERATION OF THE SYSTEM

Assuming that there is fuel in the reservoir 40, a start-up of the pump 62 will draw fuel through the filter 70 into the main pump inlet 80 and out of the main outlet 86 (FIG. 1). At the same time, a secondary diversionary pump outlet 65 (FIG. 3) delivers fuel under pressure to the jet orifice 66 and into the venturi passage 64. The drop in pressure due to the venturi action will pull fuel from the main fuel tank through the fuel inlet 49 into the chamber 58 where it will be discharged through the venturi to the interior of the reservoir. The reservoir will be receiving liquid fuel, and air will be vented through port 122 until the fuel level reaches the float 126 illustrated in FIG. 1. The lifting of the float will cause the valve stem 124 to close the port 122. This will cause pressure in the reservoir to build up and create back pressure at the outlet end of the venturi tube, thus effectively stopping the entrance of fuel into the reservoir. This back pressure in the reservoir will also cause a force feed of fuel from the reservoir into the main pump inlet 80 and thus increase the efficiency of the main pump delivering fuel to a vehicle engine.

In FIG. 2, the valve 124, shown in FIG. 1, is eliminated and the calibrated vent 140 allows air to escape as the reservoir fills. When liquid fuel reaches the vent 140, the additional viscosity of the fuel slows any significant escape of fuel through the vent and pressure builds up in the reservoir to create back pressure in the reservoir and a consequent reduction of fuel exiting the venturi tube. Again, this pressure build up will increase pressure on fuel entering the main pump inlet and increase the efficiency of the main fuel pump.

The fuel return passage 104 will direct excess fuel at a low pressure from a pressure regulator (not shown) into the reservoir through duck bill valve 110 which is a one-way valve into the reservoir.

What is claimed is:

1. A fuel delivery system for an automotive vehicle which comprises, a closed reservoir constructed to be received in a main fuel tank of a vehicle, a first pump received in said reservoir and having a jet and a venturi passage with an inlet communicating with the main tank adjacent the bottom of the main tank and an outlet opening into and communicating with the interior of the reservoir adjacent the bottom of the reservoir, a first valve communicating with said first inlet which opens to permit liquid fuel from the main tank to flow through the first inlet and closes to prevent reverse flow of fuel from the reservoir through the first inlet and into the main tank when during operation of the system the liquid fuel in the reservoir is at a superatmospheric pressure, a second pump received with said reservoir and having an electric motor for driving the second pump, a second fuel inlet communicating with the interior of the reservoir adjacent the bottom of the reservoir and being independent of both the first inlet and the first outlet of said first pump, a second outlet opening to the exterior of said reservoir for supplying fuel under pressure from the interior of said reservoir to an engine of the vehicle, and a secondary diversionary outlet connected to said jet for supplying liquid fuel under pressure from said second pump to said jet to operate said first pump, a return inlet communicating with the interior of said reservoir adjacent the top of said reservoir for returning unused fuel from the engine to said reservoir, a second one-way valve communicating with said return inlet which permits fuel to flow into the interior of said reservoir and closes to prevent reverse flow out of the reservoir through said return inlet, and a vent communicating with the interior of said reservoir adjacent the top of said reservoir for venting gas and fuel vapor from the interior of said reservoir as the level of liquid in said reservoir rises and for effectively retarding or stoping the venting of gas and fuel vapor when the fuel level in said reservoir rises to adjacent the top of said reservoir and while said second pump is being operated by the electric motor to thereby increase the pressure of fuel within the reservoir to a superatmospheric pressure to retard and effectively stop the delivery of fuel by said first pump to the interior of the reservoir while the level of liquid fuel is adjacent the top of said reservoir and when the level of fuel in the reservoir drops sufficiently, the vent will reduce the superatmospheric pressure within the reservoir so that said first pump will operate to supply liquid fuel from the main tank to the interior of the reservoir to increase the level of liquid fuel in the reservoir.

2. A fuel delivery system as defined in claim 1 in which said vent adjacent the top of said reservoir comprises a valve opening, and a float valve positioned to cooperate with said opening to close said opening in response to fuel level adjacent the top of said reservoir.

3. A fuel delivery system as defined in claim 1 in which said vent adjacent the top of said reservoir comprises a calibrated vent opening which readily vents air and vapor from said reservoir but in response to the presence of liquid fuel effectively causes pressure to build up in said reservoir.

4. A fuel delivery system as defined in claim 1 in which said second one-way valve comprises a duck bill valve.

5. A fuel system as defined in claim 1 in which said first valve comprises a foot valve.

6. A fuel system as defined in claim 1 in which said first valve comprises a foot valve having a seat communicating with the main fuel tank and a valve plate overlying said seat and movable to a first position spaced from said seat to permit the flow of liquid fuel from the tank into said first inlet of said first pump, and to a second position bearing on said seat to prevent the reverse of flow of liquid fuel from the interior of said reservoir through said first pump and into the main fuel tank.

7. A fuel system as defined in claim 1 which also comprises a fuel filter received within the reservoir and disposed between said first outlet of said first pump and said second inlet of said second pump.

8. A fuel system as defined in claim 1 which also comprises an annular fuel filter received in said reservoir between a wall of said reservoir and a housing of said first pump for filtering liquid fuel supplied to said second inlet of said second pump.

* * * * *